United States Patent [19]

Kristoffersson et al.

[11] 4,354,551

[45] Oct. 19, 1982

[54] HEAT EXCHANGER

[75] Inventors: Ingmar Kristoffersson, Rönninge; Gustav S. Heurlin, Trångsund, both of Sweden

[73] Assignee: Alfa-Laval AB, Sweden

[21] Appl. No.: 151,803

[22] Filed: May 21, 1980

[30] Foreign Application Priority Data

May 25, 1979 [SE] Sweden ..... 7904587

[51] Int. Cl.³ ..... F28F 3/00

[52] U.S. Cl. ..... 165/166; 62/515

[58] Field of Search ..... 62/515; 165/164, 165, 165/166, 145

[56] References Cited

U.S. PATENT DOCUMENTS 1,810,165 6/1931 Frank et al. ..... 165/145

2,021,009 11/1935 Ireland ..... 165/145

2,395,543 2/1946 Gallaher ..... 165/145

3,916,644 11/1975 Nasser ..... 165/166 X

*Primary Examiner*—Albert W. Davis

*Assistant Examiner*—Margaret A. Focarino

*Attorney, Agent, or Firm*—Cyrus S. Hapgood

[57] ABSTRACT

The invention relates to a heat exchanger intended for cooling of a fluid when a compressed refrigerant is evaporated. The heat exchanger comprises one or more plate-shaped pressure cells (1, 1', 1'') provided with inlet (6) and outlet (9) for refrigerant. The pressure cell consists of thin plates which have been joined together along their outer edges and at points over the heat exchange surface. The pressure cell is surrounded by a container (2) for the fluid which is to be cooled when the refrigerant changes its state.

2 Claims, 5 Drawing Figures

HEAT EXCHANGER

BACKGROUND

The present invention relates to a heat exchanger which is intended to cool a fluid when a compressed refrigerant is evaporated.

Heat exchangers intended for this application have long consisted of tube and shell evaporators. A heat exchanger of this type, which is described e.g. in the German published application 22 57 427, consists of a bundle of tubes with horizontally arranged coaxial tubes surrounded by a shell. The inner of the two coaxial tubes constitutes the inlet tube for the refrigerant to be evaporated. The evaporated refrigerant is led back through the outer tubes and out from the heat exchanger, while the media which is to be cooled flows in the space between the bundle of tubes and the shell.

In French Pat. No. 929 204, there is shown an evaporator with horizontal tubes. These are connected at their lower ends to a distributing chamber and at their upper ends to a collection chamber for evaporated gas. The distributing chamber, the evaporating tubes, and the collection chamber are surrounded by a container through which the liquid which is to be cooled flows.

BRIEF DESCRIPTION OF THE INVENTION

According to the invention, there is provided a new type of evaporator with large cooling capacity in spite of a small volume. The new heat exchanger may be shaped in many different ways within the scope of the invention depending on the application for which it is to be used.

The heat exchanger according to the invention is characterized in that it comprises at least one pressure cell plate in which the compressed refrigerant is evaporated. The pressure cell plate is provided with a means which achieves a pressure drop in the refrigerant. It is also provided with inlets and outlets for refrigerant and consists of thin plates which are joined together along their outer edges, and at points over the heat exchanging area. The pressure cell is surrounded by a container for the fluid which is to be cooled when the refrigerant changes its state.

With the described shaping of the space in which the compressed refrigerant is evaporated there is achieved an especially effective heat exchange between the refrigerant and the surrounding fluid over a large heat exchanging area. The point joints, which are evenly distributed over the heat exchanging area, influence the flowing conditions in the pressure cell in such a way that the heat exchange is improved. Depending on the available capacity of the compressor and the temperature to which fluids of different temperature are to be cooled, the flow conditions both for the refrigerant and the fluid may be varied according to needs.

The heat exchanger preferably comprises a number of pressure cells instead of only one pressure cell, which, depending upon the application, may be connected in series or parallel in such a way that the refrigerant is brought to flow through all of the pressure cells or connected to a common distributing chamber from which the refrigerant is led to the pressure cells.

When the pressure cells are connected to each other in series, the evaporator is provided with a means which achieves a pressure drop at the inlet of the first of the presure cells connected in series. It is also possible to provide each pressure cell with an expansion valve or a thin inlet tube for compressed, condensed refrigerant. Each pressure cell is then provided with a suction pipe for carrying away evaporated refrigerant.

The pressure cells are advantageously divided in two halves through a longitudinal joint which extends along almost the whole pressure cell, at which the inlet for refrigerant into the pressure cell is arranged in one half and the outlet for refrigerant in the other half, and both halves are connected together at the end of the pressure cell opposite to the inlets and outlets for refrigerant.

The heat exchanger is advantageously shaped such that the fluid which is to be cooled is brought to pass each pressure cell. It is suitable to lead the fluid in counterflow, and the pressure cells are then arranged such in relation to each other that a passage for the fluid is achieved alternatively at the one or at the other side of the pressure cells. It is also possible to achieve the connection by means of a through flow hole through the pressure cells.

The material in the pressure cells is chosen depending upon the fluid which is to be cooled. If the fluid is a food, stainless steel is usually needed, in spite of the fact that the thermal conductivity of this material is relatively low. In other connections, e.g. within the processing industry, metallic materials with better thermal conductivity, as for example copper may be used.

In order to achieve a pressure-tight joinder of the cell the plates are welded together along their outer edges. It is also possible to bond the plates together with a suitable adhesive. The pressure cell may be two separate plates or one folded plate.

The refrigerant which is to be used in the heat exchanger may be a suitably halogenated hydrocarbon such as Freon.

THE DRAWINGS

The invention is described further with reference to the attached drawings which shown one embodiment of an evaporator chosen as example.

DESCRIPTION OF A PREFERRED EMBODIMENT

Figure 2:
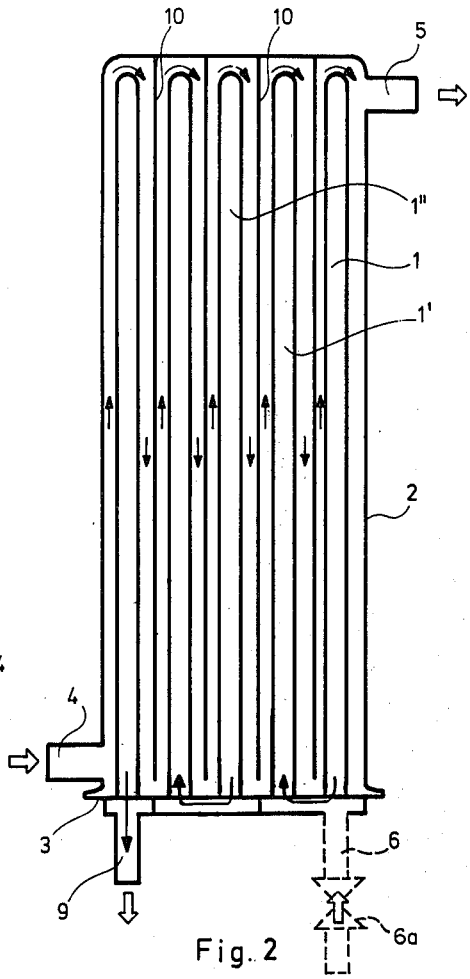
FIG. 2 shows a section along the line II—II in FIG. 1.
Figure 5:
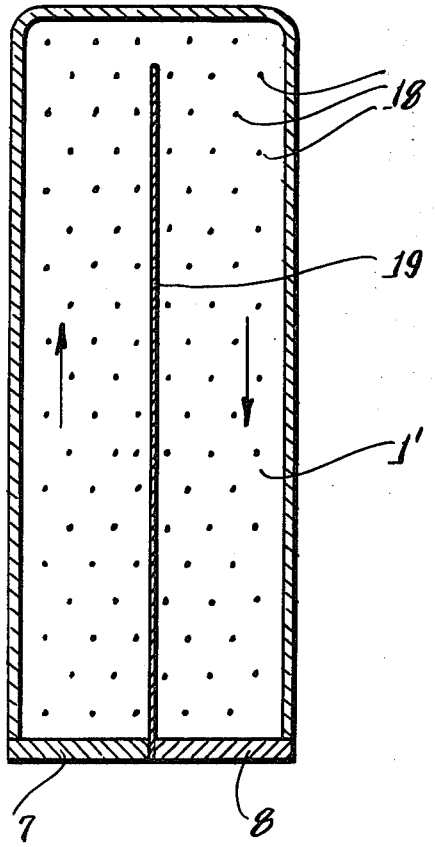
FIG. 5 shows one of the pressure cells seen from the side.

As may be seen in FIG. 2, the evaporator comprises a number of pressure cells 1, 1', 1'' surrounded by a container 2 and a bottom plate 3. The container is provided with inlet 4 and outlet 5 for a fluid which is to be cooled in the evaporator. In the bottom plate 3 there is an inlet tube 6 for compressed, condensed refrigerant. Connected to the evaporator there is expansion valve, 6*a*, which achieves a pressure drop. Instead of the expansion valve, the pressure drop may be achieved by means of a capillary tube. The inlet tube 6 opens in the lower part of the pressure cell 1 which by a longitudinal welding shown in FIG. 5 is divided into two halves. The longitudinal weld joint ends a distance from the upper edge of the pressure cell. The pressure cell has also been provided with spot welded joints over the heat exchanging area. These increase the pressure durability of the pressure cell and make the flow conditions in the pressure cell better. The evaporated refrigerant is forced to flow through all of the pressure cells. The first pressure cell 1 communicates with the next pressure cell 1' at its lower edge through a space 7 which communicates with both these pressure cells. The distributing arrangement of spaces (7, 8 . . . ) connecting the pressure cells is of particular advantage. The pressure cells 1' and 1'' communicate with each other through a space 8 and so on. The evaporated refrigerant leaves the heat exchanger through an outlet 9. In order to force the fluid which is to be cooled in the evaporator to pass each pressure cell, there are partition walls 10 in the container 2 which extend almost to the bottom plate 3. These increase the flow rate through the evaporator in that the flow area is diminished. A compressed, condensed refrigerant is brought to pass an expanding valve and is then immediately led into the evaporator. The fluid which is to be cooled is led into the evaporator in counter-flow in relation to the refrigerant. The heat necessary for the evaporation is taken from the fluid which is cooled thereby.

Figure 1:
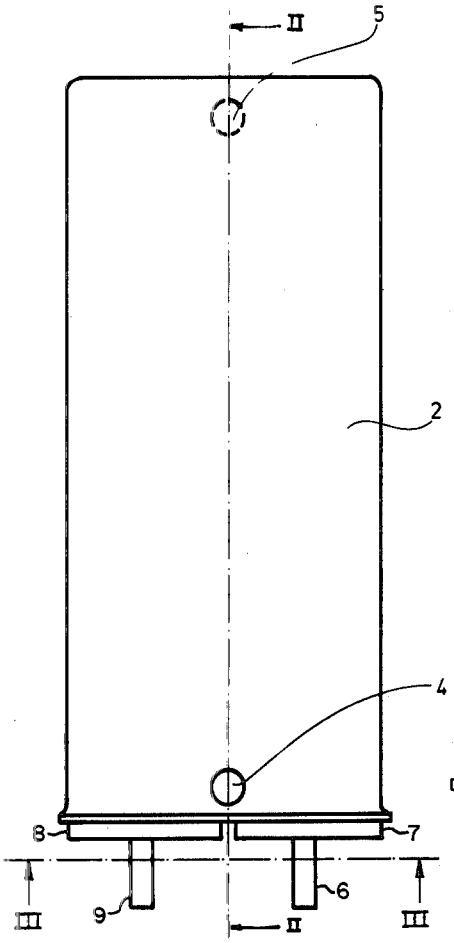
FIG. 1 shows the evaporator seen from the side.
Figure 3:
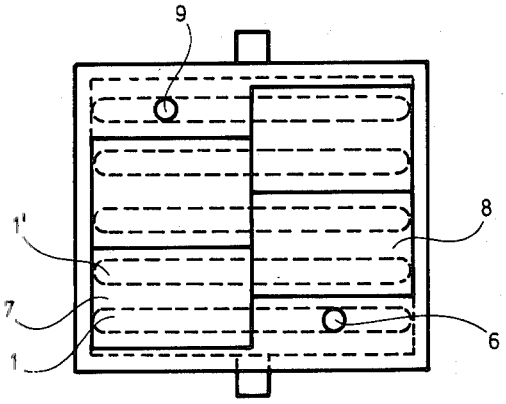
FIG. 3 shows the evaporator seen from below according to III—III in FIG. 1.
Figure 4:
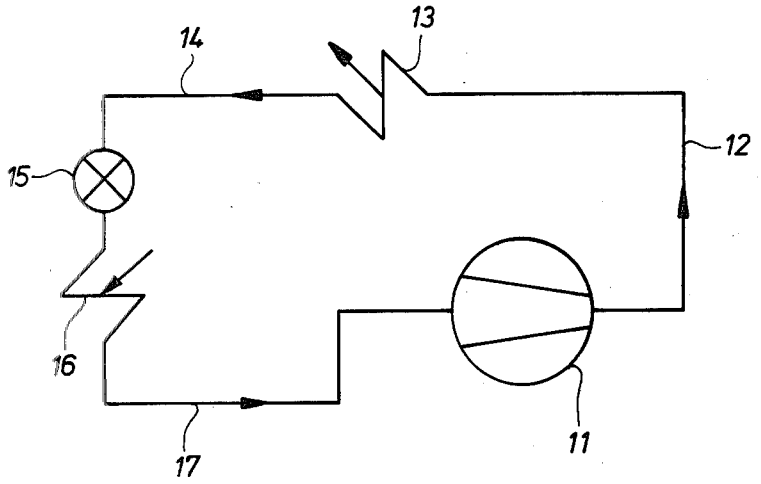
FIG. 4 shows a cooling cycle, chosen as example, comprising the described evaporator.

FIG. 4 shows a cooling cycle, in which there is an evaporator of the type described in FIGS. 1–3. The cooling cycle comprises a compressor 11 which compresses the circulating refrigerant. The compressor is connected by a conduit 12 to a condenser 13, in which the refrigerant is condensed. The compressed, condensed refrigerant is led by a conduit 14 and an expansion valve 15 to an evaporator 16 of the described kind. The refrigerant is evaporated and is led back to the compressor by a conduit 17 in order to be compressed again and so on. The pressure in the evaporator may be as high as 35 atm during operation.

In FIG. 5 there is shown one of the pressure cells (1'). As may be seen on the drawing the plates are joined together by spot welding at points (18) over the heat exchanging area. The pressure cell is divided into 2 halves by means of a longitudinal welding (19). The refrigerant enters through the space 7 flows upwards in the left part of the cell in the direction of the arrow until it reaches the top of the cell. Here it flows downwards in the right part of the cell and leaves the same through space 8 which also communicates with the next pressure cell (1'').

In the described embodiment, the pressure cells are arranged such that the refrigerant passages within them are very narrow, for example ~3 mm. This means that the heat exchanging areas constitute a very large part of the available volume of the cell. The spot weldings which are distributed over the heat exchange area increase the turbulence within the cell and consequently the heat exchange.

Alternatively, the container may be filled with fluid and the refrigerant may then be led to the evaporator. When the desired cooling has been obtained, the fluid is led away from the cooler. If the desired cooling has not been obtained by means of one passage through the evaporator, the flowing fluid may be recirculated.

For food applications, it is necessary to be able to clean the heat exchanger efficiently. The proposed heat exchanger may be cleaned during operation, so called CIP-cleaning, but it is also possible to clean the heat exchanger more carefully by opening the container and the bottom plate 3 at regular intervals. In this way, it is possible to clean the heat exchanging areas of the pressure cells mechanically.

In the shown embodiment of the invention, the pressure cells are surrounded by a rectangular container. Of course, the pressure cells may instead be surrounded by a container of any other form, for example a cylindrical container. In such an arrangement, pressure cells with different heat exchange areas are to be found.

We claim:

1. Heat exchanger for cooling a fluid by the evaporation of a compressed refrigerant, characterized in that the heat exchanger comprises at least one plate-shaped pressure cell provided with an inlet and an outlet for refrigerant, and a means which achieves a pressure drop in the refrigerant, at which the pressure cell consists of thin plates which are joined together along their edges and at points over the heat exchanging area and that the pressure cell is surrounded by a container for the fluid which is to be cooled when the refrigerant changes its state, the exchanger comprising a number of plate-shaped pressure cells which are connected in series such that the refrigerant is brought to pass through all of the pressure cells, and a means which achieves the pressure drop in the compressed, condensed refrigerant arranged at the inlet to the first of the pressure cells which are joined together, an outlet for the evaporated refrigerant being arranged at the last pressure cell, each pressure cell being divided into two halves by means of a longitudinal joint in such a way that the inlet for refrigerant to the pressure cell is arranged in one half and the outlet for refrigerant in the other half, both halves being connected to each other at the opposite end of the pressure cell.

2. Heat exchanger according to claim 1, characterized in that fluid which is to be cooled is brought to pass each pressure cell in counter flow.

* * * * *